US009769574B2

(12) United States Patent
Kristensen et al.

(10) Patent No.: US 9,769,574 B2
(45) Date of Patent: Sep. 19, 2017

(54) HEARING DEVICE COMPRISING AN ANTI-FEEDBACK POWER DOWN DETECTOR

(71) Applicant: Oticon A/S, Smørum (DK)

(72) Inventors: Michael Smed Kristensen, Smørum (DK); Anders Meng, Smørum (DK); Steen Michael Munk, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 15/052,308

(22) Filed: Feb. 24, 2016

(65) Prior Publication Data

US 2016/0249139 A1 Aug. 25, 2016

(30) Foreign Application Priority Data

Feb. 24, 2015 (EP) ..... 15156224

(51) Int. Cl.
*H04R 25/00* (2006.01)

(52) U.S. Cl.
CPC ..... *H04R 25/505* (2013.01); *H04R 25/305* (2013.01); *H04R 25/453* (2013.01); *H04R 25/552* (2013.01); *H04R 2460/03* (2013.01)

(58) Field of Classification Search
CPC . H04R 25/00; H04R 2225/49; H04R 2460/01
(Continued)

(56) References Cited

U.S. PATENT DOCUMENTS 6,240,192 B1 * 5/2001 Brennan ..... H04R 25/505 381/312

2008/0095389 A1 * 4/2008 Theverapperuma . H04R 25/453 381/318

(Continued)

FOREIGN PATENT DOCUMENTS

EP 2 613 566 A1 10/2013

*Primary Examiner* — Suhan Ni
(74) *Attorney, Agent, or Firm* — Birch, Stewart, Kolasch & Birch, LLP

(57) ABSTRACT

The application relates to a hearing device comprising a) a forward path between an input transducer for converting an input sound to an electric input signal and an output transducer for converting an electric output signal to an output sound, the forward path comprising a signal processing unit for applying a level and/or frequency dependent gain to the electric input signal or a signal originating therefrom and for providing a processed signal, and feeding the processed signal or a signal originating therefrom to the output transducer, an acoustic feedback path being defined from said output transducer to said input transducer; b) a configurable anti-feedback system comprising a feedback estimation unit for providing an estimate of said acoustic feedback path; c) a number of detectors, each providing a detector signal for characterizing a signal of the forward path. The object of the present application is to save power in a hearing device. The problem is solved in that the hearing device further comprises an activation control unit configured to control the anti-feedback system based on said detector signals, and to bring the anti-feedback system into one of at least two predefined modes based on said detector signals, said at least two predefined modes comprising an ON-mode and an OFF-mode. The invention may e.g. be used in hearing aids, headsets, ear phones, active ear protection systems, or similar portable devices, where a need for feedback cancellation and low power consumption is important.

20 Claims, 8 Drawing Sheets

(58) Field of Classification Search
USPC ..... 381/312, 317–318
See application file for complete search history.

(56) References Cited

U.S. PATENT DOCUMENTS

| | | | | |
|---|---|---|---|---|
| 2011/0293124 | A1* | 12/2011 | Ma | H04R 25/453 381/318 |
| 2014/0321682 | A1 | 10/2014 | Kofod-Hansen et al. | |
| 2015/0139460 | A1* | 5/2015 | Pedersen | H04R 25/453 381/318 |

* cited by examiner

HEARING DEVICE COMPRISING AN ANTI-FEEDBACK POWER DOWN DETECTOR

TECHNICAL FIELD

The present application relates to feedback suppression in hearing devices, e.g. hearing aids, in particular to a hearing device comprising an activation control unit for controlling the activation and de-activation of a feedback suppression system, e.g. with a view to minimizing power consumption.

Embodiments of the disclosure may e.g. be useful in applications such as hearing aids, headsets, ear phones, active ear protection systems, or similar portable devices, where a need for feedback cancellation and low power consumption is important.

BACKGROUND

State of the art hearing devices comprise a number of algorithms to deal with various specific tasks (typically related to different acoustic environments encountered by the hearing device/user, and/or to the particular needs of the user), e.g. noise reduction, directionality, level dependent compression, frequency dependent amplification, frequency compression, streamed audio reception, etc.

As both the number of algorithms and the complexity of these algorithms rise in a hearing device, the need for managing the use of the algorithms, e.g. for powering/scaling down algorithms (or only a part of algorithm) in order to save power and thus prolong the battery lifetime emerges.

US20140321682A1 describes various sensors for use in an automatic power down of a hearing instrument with a view to reducing power consumption when not in use (e.g. not worn be the user). A reduced draw on the battery increases the time between battery change (or between chargings, when rechargeable batteries are used), which increases user convenience.

However, algorithm(s) should only be powered/scaled down in time periods where this can be done without loss of performance. This calls for a Power Down Detector, which detects the time periods where an algorithm can be safely powered/scaled down.

One such algorithm relates to feedback control. Acoustic feedback from loudspeaker to microphone may be a problem in audio systems or devices (e.g. hearing devices). Adaptive feedback cancellation has the ability to track acoustic feedback path changes over time (in a feedback estimation unit). It is e.g. based on a linear time invariant filter to estimate the acoustic feedback path for which its filter weights are updated over time (i.e. an adaptive filter). The filter update may be calculated using stochastic gradient algorithms, e.g. including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

SUMMARY

When implementing an automatic (e.g. detector based) power down/power on scheme specifically for an anti-feedback system (including an adaptive algorithm for estimating a current feedback path), an important issue is timing. A feedback situation, including a howl-build up, may change rapidly, e.g. in less than 1 second. Timing is in particular important for power on of the anti-feedback system to be able to react to a howl-build up sufficiently fast to avoid (or at least to minimize) subjecting the user (and/or the user's environment) to howl.

The present solution is intended for use in an activation controller (a Power Down/On Detector) for an anti-feedback (AFB) system. The controller is preferably configured to detect when the acoustics around the hearing device (the acoustic environment) is (or is in a process of becoming) dynamic, i.e. so that the AFB system should preferably be ON (or be turned ON).

An object of the present application is to save power in a hearing device.

Objects of the application are achieved by the invention described in the accompanying claims and as described in the following.

A Hearing Device:

In an aspect of the present application, an object of the application is achieved by a hearing device comprising

- a forward path between an input transducer for converting an input sound to an electric input signal and an output transducer for converting an electric output signal to an output sound, the forward path comprising a signal processing unit for applying a level and/or frequency dependent gain to the electric input signal or a signal originating therefrom and for providing a processed signal, and feeding the processed signal or a signal originating therefrom to the output transducer, an acoustic feedback path being defined from said output transducer to said input transducer;
- a configurable anti-feedback system comprising a feedback estimation unit for providing an estimate of said acoustic feedback path;

a number of detectors, each providing a detector signal for characterizing a signal of the forward path, the hearing device further comprises an activation control unit configured to control the anti-feedback system based on said detector signals, and to bring the anti-feedback system into one of at least two predefined modes based on said detector signals, said at least two predefined modes comprising an ON-mode and an OFF-mode.

Thereby an alternative scheme for controlling an anti-feedback system in a hearing device is provided.

In an embodiment, the number of detectors is larger than or equal to one. In an embodiment, the number of detectors is larger than or equal to two. In an embodiment, the number of detectors is equal to two. In an embodiment, the number of detectors is equal to three. In an embodiment, the number of detectors is larger than three. In an embodiment, at least two detectors providing indications of dynamic acoustics are used (providing such indications at a broadband level or at a frequency sub-band level).

Dynamic acoustics are preferably determined using relatively fast acting detectors. A relatively fast acting detector is taken to have a time constant for sensing a certain change of the property it is aimed at detecting, which is below time constants of the dynamic acoustics, e.g. below 100 ms, such as below 50 ms. In an embodiment, at least one of the number of detectors is a relatively fast acting detector in the above sense.

In an embodiment, at least one of the number of detectors is configured to base its detector signal on a property of a time domain (e.g. broadband) version of the electric input signal. In an embodiment, at least one of the number of detectors is a level detector determining a level based on a time domain (e.g. broadband) version of the electric input signal, e.g. a filtered (e.g. a high-pass filtered) version of the electric input signal. In an embodiment, the filtered version of the electric input signal covers a frequency range on which the anti-feedback system is working. In an embodiment, the anti-feedback system is inactive on frequencies below a specific threshold frequency, e.g. below 1 kHz. In an embodiment, at least one of the number of detectors is a level detector of an input automatic gain control unit (iAGC) working on a (digital or analogue) time domain (e.g. broadband) version of the electric input signal from a microphone. In an embodiment, at least one of the number of detectors is working on a signal of the forward path upstream of an analysis filter bank (i.e. before the filter bank, i.e. before a time domain to (time-)frequency domain conversion of the electric input signal).

In an embodiment, an ON mode of the anti-feedback system is activated in dependence of a detector signal from a level detector indicating that the current level is below a certain input threshold level. A low input level will typically result in a relatively large gain being applied to the signal due to a compression algorithm (typically attenuating relatively large input levels and not attenuating of amplifying relatively low input levels).

In an embodiment, the power saved by changing a mode of operation of the anti-feedback system from a first mode with a relatively higher power consumption to a second mode with a relatively lower power consumption based on a control signal generated from inputs from a number of detectors is larger than the power used to generate the control signal (e.g. including the power spent by the detectors and corresponding decision circuitry).

In an embodiment, a 'predefined mode' of the anti-feedback system is taken to mean a predefined functional mode of operation, e.g. an ON-mode (where the anti-feedback system is active) or an OFF-mode (where the anti-feedback system is (substantially) in-active).

In an embodiment, an activation of a given (second) predefined mode is defined by a switching time period (TP(1→2)) for switching from a first predefined mode (e.g. an ON-mode or an OFF-mode) to the given predefined (second) mode (e.g. an OFF-mode or an ON-mode, respectively). In an embodiment, an activation of an OFF-mode from and ON-mode is defined by an ON→OFF switching time period (T(ON→OFF)) for switching the ON-mode to the OFF-mode. In an embodiment, an activation of an ON-mode from and OFF-mode is defined by an OFF→ON switching time period (T(OFF→ON)) for switching the OFF-mode to the ON-mode. In an embodiment, a switching time period for activation of a given predefined mode (by switching from a first to the given predefined mode) is determined by time constants of the number of detectors involved in the activation (switching). In an embodiment, the switching time period for activation of an ON-mode is smaller than the switching time period for activation of an OFF-mode. In an embodiment, the switching time period for activation of an ON-mode is smaller than 1 s, such as smaller than 0.5 s such as smaller than 100 ms.

In an embodiment, the one or more detectors comprises a loop gain estimator for estimating a (e.g. uncompensated, e.g. open) loop gain of the hearing device. The term 'uncompensated' is in the present context (loop gain) taken to refer to an estimated value of loop gain that has NOT been compensated by a feedback estimate, i.e. for which the feedback estimate has not been subtracted from the input (microphone) signal. A detection of loop gain is e.g. described in US2010202641A1. In an embodiment, an ON-mode of operation of the anti-feedback system is activated in case a loop gain (e.g. an uncompensated loop gain) is above a threshold value, e.g. −3 dB.

In an embodiment, the ON-mode is or comprises a maximum (or normal) power consumption mode. In an embodiment, the OFF-mode is or comprises a minimum power consumption mode. In an embodiment, the hearing device is configured to allow operation of the anti-feedback system in a number of different ON-modes, including the maximum power consumption ON-mode. In an embodiment, the hearing device is configured to allow operation of the anti-feedback system in a number of different OFF-modes, including the minimum power consumption OFF-mode. In an embodiment, the power consumption of the OFF-mode having the largest power consumption is smaller than the ON-mode having the smallest power consumption. In an embodiment, the number of predefined modes is two, an ON-mode, where the anti-feedback system operates in a normal (full or maximum power) mode of operation, and an OFF-mode (consuming a minimum power).

In an embodiment of the OFF-mode, the anti-feedback system is configured to be operated so that the power consumption is substantially zero (or as low as possible, while still allowing the system to be activated in a relatively short time, e.g. of the order of ms), e.g. consuming less than 5%, such as less than 2% compared to when in a normal ON-mode (e.g. a maximum power mode). In an embodiment of the OFF-mode, the anti-feedback system is configured to be operated in a low-power configuration, where the power consumption of the anti-feedback system is substantially lower than in the ON-mode of operation, the anti-feedback system consuming e.g. less than 30%, such as less than 20%, such as less than 10% compared to when in ON-mode (e.g. in the maximum power mode).

In an embodiment, an OFF-mode is characterized in that no feedback cancellation is performed. In an embodiment, an OFF-mode is characterized in that no feedback estimation is performed. In an embodiment, an OFF-mode is characterized in that a feedback estimation is performed at a reduced rate. In an embodiment, an OFF-mode is characterized in that no feedback cancellation is performed and in that a feedback estimation is performed at a reduced rate.

It is to be understood that even in a mode of operation, where no (new) feedback estimation (and thus no update of corresponding filter coefficients) is performed, feedback compensation/cancellation is still possible and may be performed by using the compensation filter (last filter coefficients) that was determined prior to halting the update.

In an embodiment, an ON-mode of the anti-feedback system comprises that the anti-feedback system is active and estimates a current acoustic feedback path. Preferably, the estimate of a current acoustic feedback path is used to attenuate or cancel feedback in the hearing device, e.g. by subtracting a signal representative of the estimate of a current acoustic feedback path from the electric input signal (or a signal derived therefrom).

In an embodiment, the anti-feedback system is operated in a number of frequency bands. In an embodiment, the hearing device comprises a time to time-frequency conversion unit for providing an input to the feedback estimation unit in a number of frequency bands. In an embodiment, the anti-feedback system comprises a combination unit for subtracting a signal representative of the estimate of the current acoustic feedback path from the electric input signal or a signal originating therefrom.

In an embodiment, at least one of the detector signals is frequency dependent. In an embodiment, the detector signal is provided as separate values in a number of frequency bands.

In an embodiment, the activation control unit is configured to control the anti-feedback system based on a predefined criterion comprising said detector signals.

In an embodiment, the activation control unit is configured to control the anti-feedback system based on a logic combination of predefined individual criteria, each individual criterion relating to one of said detector signals.

In an embodiment, the activation control unit is configured to bring the anti-feedback system into one of a number of modes ($ST_1$, $ST_2$, . . . , $ST_N$) based on said detector signals. In an embodiment, the number of modes N of operation of the anti-feedback system is larger than two, e.g. equal to three.

In an embodiment, at least one of the detector signals assume (only) binary values (e.g. one or zero). In an embodiment, at least one of the detector signals assume values within a range from a minimum value to a maximum value, e.g. probabilistic values (e.g. between zero and one).

In an embodiment, the hearing device (e.g. the activation control unit) is configured to provide that one of said modes ($ST_1$, $ST_2$, . . . , $ST_N$) of the anti-feedback system is an ON-mode and one of said modes is an OFF-mode. In an embodiment, the hearing device is configured to provide that the other modes (apart from the ON- and OFF-modes (e.g. minimum and maximum power consumption modes, respectively)) correspond to modes of the anti-feedback system exhibiting a power consumption between the minimum and maximum value.

In an embodiment, the hearing device is configured to allow the activation control unit to bring the anti-feedback system into a first one of said modes of operation in a first frequency band, and to bring the anti-feedback system into a second one of said modes of operation in a second frequency band. In an embodiment, the first band is different from the second band, and the first mode is different from the second mode.

In a second band anti-feedback system is configured to be operated only in a limited number of frequency bands (e.g. in one or more a specific modes of operation). In an embodiment, the anti-feedback system is configured to be operated only in critical frequency bands wherein the risk of feedback is above a certain level. In an embodiment, the anti-feedback system is configured to be operated only in frequency bands corresponding to frequencies above a lower cut-off-frequency, $f_{AFBcut}$. In an embodiment, a number of different modes of operation of the anti-feedback system are defined by a number of different (e.g. successively increasing) lower cut-off-frequencies. Thereby, a lower power consumption can be achieved by increasing the cut-off frequency. In an embodiment, the activation control unit is configured to dynamically determine critical frequency bands wherein the risk of feedback is above a certain level. In an embodiment, critical frequency bands are determined based on an estimate of loop gain versus frequency. In an embodiment, critical frequency bands are determined during a fitting session (for a given hearing aid, and preferably for a given user). In an embodiment, a risk of feedback is detected in a given frequency band, if loop gain in that band is larger than a predetermined level, e.g. −6 dB.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-)frequency domain).

In an embodiment, the number of detectors comprises an auto-correlation detector for providing a measure of the current auto-correlation of a signal of the forward path. In an embodiment, the auto-correlation detector is configured to provide the auto-correlation measure based on a Spectral Flatness Measure (SFM). In an embodiment, the predefined criterion comprises whether the value of a measure (ACM) of current auto-correlation of the signal of the forward path is above or below a given (ACM-)threshold value. In an embodiment, the auto-correlation detector operates on the full band signal (time or frequency domain). In an embodiment, the auto-correlation detector operates on the band split signals ((time-)frequency domain).

In an embodiment, the activation control unit is configured to bring the anti-feedback system in an ON-mode, if the measure of the current auto-correlation fulfills a predefined auto-correlation-criterion for the ON-mode AND if the current level of a signal of the forward path fulfills a predefined level-criterion for the ON-mode (or any another logic combination of the criteria). In an embodiment, the activation control unit is configured to bring the anti-feedback system in an OFF-mode, if the measure of the current auto-correlation fulfills a predefined auto-correlation-criterion for the OFF-mode AND if the current level of a signal of the forward path fulfills a predefined level-criterion for the OFF-mode (or any another logic combination of the criteria).

In an embodiment, the hearing device comprises an autocorrelation (AC) detector and level (L) detector. If both the AC measure is above a given (AC-)threshold and the level is above a given (L-)threshold, it is an indication of a possible acoustically dynamic situation with a risk of howl occurrences. Consequently, the AFB system should be in (or turned into) an ON-mode of operation.

In an embodiment, the number of detectors comprises a feedback detector and/or a tone detector for detecting whether tonal elements in a signal of the forward path at a given point in time comprises frequency elements that are due to feedback from the output transducer to the input transducer, said detector providing a detector signal indicative thereof. In an embodiment, the predefined criterion comprises whether the detector signal indicates that the signal of the forward path at a given point in time is due to feedback or not (the latter implying that a particular tonal component is part of a signal from the environment).

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof. In an embodiment, a detector signal indicative of such movement is used to activate an ON-mode of the anti-feedback system.

In an embodiment, the hearing device comprises first and second input transducers, and corresponding first and second configurable feedback cancellation systems comprising first and second feedback estimation units for estimating first and second acoustic feedback paths from the output transducer to the first and second input transducers, respectively.

In an embodiment, the feedback estimation unit comprises an update part comprising an adaptive algorithm and a variable filter part for filtering an input signal according to variable filter coefficients determined by said adaptive algorithm, wherein the update part is configured to update said filter coefficients of the variable filter part with a configurable update frequency $f_{upd}$. In an embodiment, the hearing device is configured to provide that the configurable update frequency $f_{upd}$ has a maximum value $f_{upd,max}$. In an embodiment, the maximum value $f_{upd,max}$ is a fraction of a sampling frequency $f_s$ of an AD converter of the hearing device ($f_{upd,max}=f_s/D$). In an embodiment, the configurable update frequency $f_{upd}$ has its maximum value $f_{upd,max}$ in an ON-mode of operation of the anti-feedback system (e.g. the maximum power mode). In an embodiment, the hearing device is configured to provide that—in a mode of operation of the anti-feedback system other than the maximum power ON-mode—the update frequency of the update part is scaled down by a predefined factor X compared to said maximum update frequency $f_{upd,max}$. In an embodiment, the update frequency $f_{upd}$ in different ON-modes of operation (other than the maximum power ON-mode) is scaled down with different factors $X_i$, i=1, . . . , ($N_{ON}$-1), where $N_{ON}$ is the number of ON-modes of operation of the anti-feedback system.

The update part of the adaptive filter comprises an adaptive algorithm for calculating updated filter coefficients for being transferred to the variable filter part of the adaptive filter. The timing of calculation and/or transfer of updated filter coefficients from the update part to the variable filter part may be controlled by the activation control unit. The timing of the update (e.g. its specific point in time, and/or its update frequency) may preferably be influenced by various properties of the signal of the forward path. The update control scheme is preferably supported by one or more of the detectors of the hearing device, preferably included in a predefined criterion comprising the detector signals.

In an embodiment, the anti-feedback system—in a specific ON-mode of operation—is operated only in critical bands, wherein the risk of feedback is above a certain level. In an embodiment, the anti-feedback system—in a specific ON-mode of operation—is operated only in a specific number of the most critical bands, wherein the risk of feedback is highest.

In an embodiment, the activation control unit is configured—in a specific ON-mode of operation—to control the update parts of the first and second feedback estimation units to alternatingly update the filter coefficients of the respective variable filter parts. Thereby, a 50% power saving (at a given update frequency $f_{upd}$) is provided by—at a given update time instance (every $1/f_{upd}$)—alternatingly inhibiting the update of the first (e.g. corresponding to the acoustic feedback path to the front input transducer) and second (e.g. corresponding to the acoustic feedback path to the rear input transducer) acoustic feedback path estimates (i.e. disabling the calculation and application of update filter coefficients). In an embodiment, the update parts of the first and second feedback estimation units are updated with the same update frequency, but at different points in time. In an embodiment, the update parts of the first and second feedback estimation units are updated with different update frequencies, one (e.g. the one corresponding to the feedback path of the rear microphone) being lower than the other (e.g. the front), e.g. a scaled down version ($f_{upd}(R)=f_{upd}(F)/Z$), where Z is an integer, e.g. 10 or less.

In an embodiment, the activation control unit—in an OFF-mode of operation—is configured to bring the anti-feedback system into an ON-mode of operation according to a predefined time scheme to estimate a current acoustic feedback path and subsequently to revert to the OFF-mode. In an embodiment, the filter coefficients are updated and a signal representative of the current estimate of the acoustic feedback path is subtracted from a signal of the forward path. In an embodiment, the predefined time scheme comprises a periodic OFF to ON mode transition and subsequent ON to OFF mode transition (when the filter coefficients have been determined and possibly applied). In an embodiment, the period is configurable. Thereby possible slow consistent changes in the feedback path can be tracked (even when the system is (otherwise) in an OFF-mode).

In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the hearing device has a maximum outer dimension of the order of 0.08 m (e.g. a head set). In an embodiment, the hearing device has a maximum outer dimension of the order of 0.04 m (e.g. a hearing instrument).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a level and/or frequency dependent gain according to a user's particular needs. In an embodiment, the hearing device is adapted to provide a transposition (with or without frequency compression) of one or more frequency ranges to one or more other frequency ranges, e.g. to compensate for a hearing impairment of a user. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device further comprises other relevant functionality for the application in question, e.g. compression, noise reduction, etc.

In an embodiment, the hearing device comprises a hearing aid, a headset, an earphone, an ear protection device or a combination thereof. In an embodiment, the hearing device comprises a listening device, e.g. a hearing aid, e.g. a hearing instrument, e.g. a hearing instrument adapted for being located at the ear or fully or partially in the ear canal of a user.

Use:

In an aspect, use of a hearing device as described above, in the 'detailed description of embodiments' and in the claims, is moreover provided. In an embodiment, use is provided in a system comprising (e.g. battery driven) audio distribution, e.g. a system comprising a microphone and a loudspeaker in sufficiently close proximity of each other to cause feedback from the loudspeaker to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is another hearing device. In an embodiment, the hearing system comprises two hearing devices adapted to implement a binaural hearing system, e.g. a binaural hearing aid system.

In an embodiment, the binaural hearing system is configured detector to allow signals from one or more detectors to be exchanged between the two hearing devices (e.g. hearing aids) of the binaural hearing system (e.g. a binaural hearing aid system). In an embodiment, the binaural hearing system is configured to provide that a detector signal defining a measure of a (first) property of a signal of the forward path of a given hearing device is transmitted to the other hearing device for comparison with a measure of the same (first) property of a signal of the forward path of the other hearing device. In an embodiment, the comparison (of respective first properties from the two hearing devices) is used to influence whether or not a change of mode of operation of the anti-feedback system of the hearing aid in question should be initiated (e.g. from an OFF-mode to an ON-mode or vice versa).

In an embodiment, a detector signal defining a measure of an autocorrelation (AC1) of a signal of the forward path of a given hearing device (HD1) is transmitted to the other hearing device (HD2) for comparison with a measure of an autocorrelation (AC2) of a signal of the forward path of the other hearing device (HD2). In an situation, where both measures of an autocorrelation (AC1, AC2) are indicative of the autocorrelation being larger than a threshold value in both hearing devices (at the same time), the source of the current autocorrelation is associated with the acoustic environment (not a howl in one of the hearing devices). Consequently, an activation of an ON-mode of operation of the anti-feedback system need not be initiated. Oppositely, in a situation, where the measures of an autocorrelation (AC1, AC2) are indicative of the autocorrelation being larger than a threshold value in (only) one of the hearing devices (HD1, HD2), the source of the current autocorrelation is associated with a howl (or build-up of a howl) in that one of the hearing devices (e.g. HD2) having an autocorrelation larger than the threshold value. Consequently, an activation of an ON-mode of operation of the anti-feedback system in the relevant hearing device (HD2) may be initiated.

Definitions:

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window.

A 'hearing system' refers to a system comprising one or two hearing devices, and a 'binaural hearing system' refers to a system comprising one or two hearing devices and being adapted to cooperatively provide audible signals to both of the user's ears. Hearing systems or binaural hearing systems may further comprise 'auxiliary devices', which communicate with the hearing devices and affect and/or benefit from the function of the hearing devices. Auxiliary devices may be e.g. remote controls, audio gateway devices, mobile phones, public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1A:
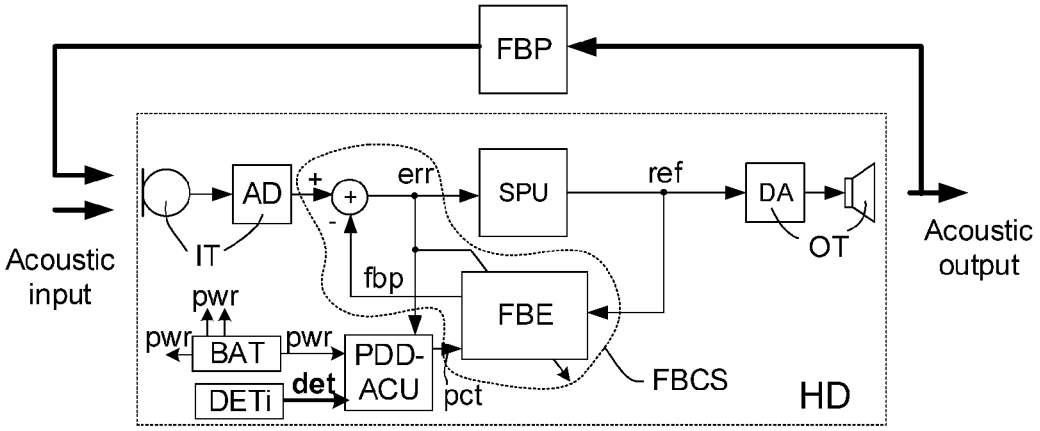
FIGS. 1A, 1B and 1C shows three embodiments of a hearing device according to the present disclosure.
Figure 1B:
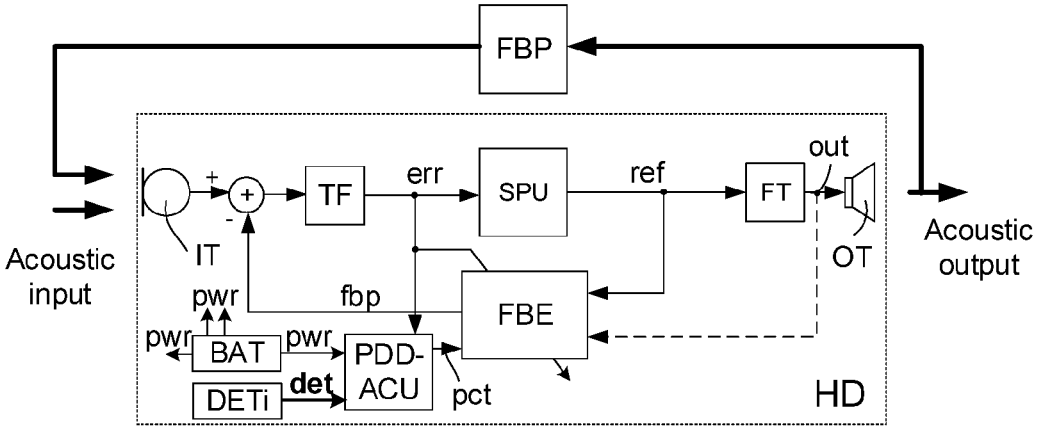
Figure 1C:
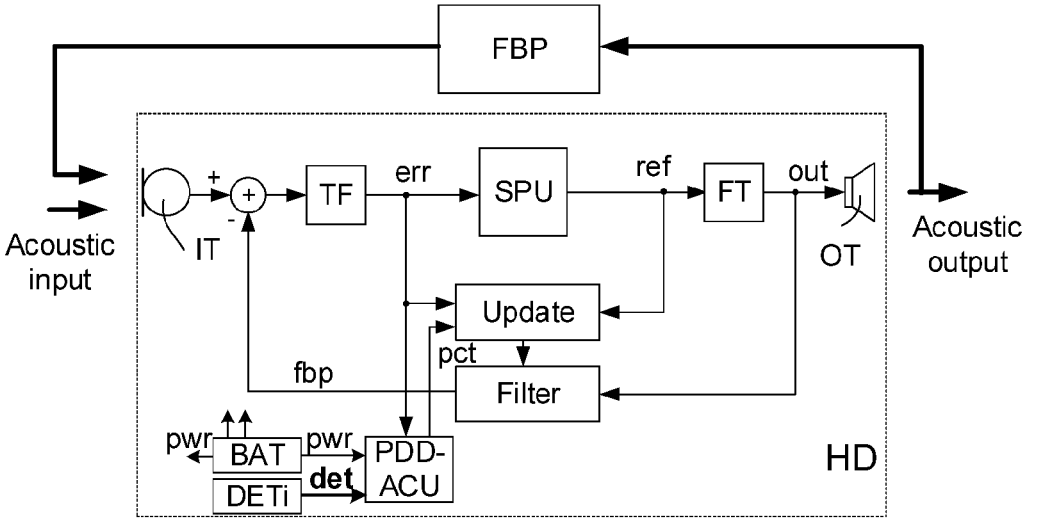

FIG. 1A, 1B, 1C schematically shows three embodiments of a hearing device according to the present disclosure.

FIG. 1A schematically shows exemplary basic functions of a hearing device (HD) comprising a forward or signal path from an input transducer (IT) to an output transducer (OT). The input transducer (IT) comprises a microphone for converting an input sound (Acoustic input in FIG. 1A, 1B, 1C) to an analogue electric input signal and an analogue-to-digital (AD) converter to digitize the analogue electric input signal from the microphone with a predefined sampling rate, e.g. 20 kHz, and provide a digitized electric input signal to the forward path. The output transducer (OT) comprises a digital-to-analogue (DA) converter to convert a digital signal to an analogue electric output signal and a loudspeaker presenting the analogue electric output signal to a user as an output sound (Acoustic output). The forward path comprises a signal processing unit (SPU) for applying a level and/or frequency dependent gain to the signal from the input transducer (or a signal derived therefrom) and providing an enhanced signal to the output transducer. An 'external' or 'acoustic' feedback path (FBP) from output to input transducer of the hearing device is indicated. The external feedback path leaks a part of the output sound from the output transducer (Acoustic output) to the input transducer (as indicated by the bold arrow from the output transducer to the input transducer. The input sound (Acoustic input) presented at the input transducer (IT) comprises this leaked 'feedback signal' in combination with any sound from the environment (as indicated by the bold arrow beneath the acoustic feedback path). The hearing device (HD) further comprises an anti-feedback system (FBCS) comprising a feedback estimation unit (FBE) for estimating the acoustic feedback path (FPB) from the output transducer to the input transducer and providing a signal fbp representative thereof. The anti-feedback system (FBCS) further comprises a summation (subtraction) unit ('+') for subtracting the signal fbp representative of the current acoustic feedback path from the (digitized) electric input signal and providing a feedback corrected signal (error signal err), which is fed to the signal processing unit (SPU), to the feedback estimation unit (FBE). The hearing device (HD) further comprises a battery (BAT) for providing current to the functional blocks of the hearing device (cf. signals pwr) and a power down detector and an activation control unit (PDD-ACU). The power down detector part (PDD) comprises a number of detectors, each providing a detector signal for characterizing a signal of the forward path (here signal err). Alternatively or additionally, the hearing device (HD) may comprise a number of detectors (unit DETi, i=1, 2, . . . , $N_D$, where $N_D$ is the number of detectors) providing respective detector signals det (bold arrow from the DETi unit to the PDD-ACC-unit). In an embodiment, one or more of the detectors are external to the hearing device, and the hearing device is configured to receive control signals from such external detectors (e.g. via appropriate wireless transceivers, see e.g. FIG. 7). A number of detectors that may be used to provide input to the power down detector and activation control unit (PDD-ACU) are disclosed in US20140321682A1. The activation control part (ACU) is configured to control the anti-feedback system (FBCS) based on the detector signals (cf. power control signal pct), and to bring the anti-feedback system into one of at least two predefined modes based on the detector signals. The at least two predefined modes comprises an ON-mode and an OFF-mode. The ON-mode comprises a normal power consumption mode. The OFF-mode comprises a minimum power consumption mode. The processing of the hearing device may be performed fully or partially in the time domain.

FIG. 1B shows an embodiment of a hearing device (HD) as shown in FIG. 1A, but additionally comprising a time to time frequency conversion unit (TF) (e.g. an analysis filter bank) located in the forward path between the summation unit ('+') and the signal processing unit (SPU) and a time-frequency domain to time domain conversion unit (FT) (e.g. a synthesis filter bank) located in the forward path between the signal processing unit (SPU) and the output transducer (OT). Thereby the signal processing of the forward path between the conversion units (TF, FT) can be performed in a number of frequency bands. In particular, the input signal err to and the processed signal ref from the signal processing unit (SPU) are provided in a number of frequency bands (e.g. 16 or 32 or 64). The time to time frequency conversion unit (TF) converts processed band split signal ref to a time domain signal out, which is fed to output transducer (OT) for presentation to a user as an acoustic signal (Acoustic output). In the embodiment of FIG. 1B, the feedback estimation unit (FBE) provides the acoustic feedback path estimate signal fbp in the time domain and is configured to base the estimate on the processed frequency domain signal ref. In an embodiment, the acoustic feedback path estimate signal fbp is additionally based on the time domain signal out (cf. dashed line to the feedback estimation unit (FBE), and FIG. 1C). In the embodiments of FIGS. 1B and 1C, the input and output transducers (IT and OT, respectively) are assumed to contain possible analogue to digital (AD) and digital to analogue (DA) converters.

The feedback estimation units (FBE) of the embodiments of a hearing device shown in FIGS. 1A and 1B may comprise an adaptive filter, which is controlled by a prediction error algorithm, e.g. an LMS (Least Means Squared) algorithm, in order to predict and cancel the part of the input transducer (here microphone) signal that is caused by feedback. FIG. 1C illustrates an example of this. FIG. 1C shows an embodiment of a hearing device (HD) as shown in FIG. 1B, but where the feedback estimation unit (FBE in FIGS. 1A and 1B) comprises an adaptive filter. The adaptive filter in FIG. 1C comprises a variable filter part (Filter in FIG. 1C) and an adaptive prediction error algorithm part (Update in FIG. 1C). The feedback estimation unit (adaptive filter Update, Filter) is (here) aimed at providing a good estimate of the 'external' feedback path from the output transducer (OT) to the input transducer (IT). The prediction error algorithm (of the Update unit) uses a reference signal (ref) together with a signal of the forward path originating from the microphone signal (here feedback corrected signal err from the combination unit (+)) to find the setting (filter coefficients) of the adaptive filter (when applied to the Filter) that minimizes the prediction error when the reference signal (ref) is applied to the adaptive filter (input to Filter part). The update of filter coefficients (acoustic feedback path estimate) as determined in the Update part of the adaptive filter is controlled by power control signal pct from the activation control unit (ACU). In the embodiment of FIG. 1C, the calculation of filter coefficients in the Update part of the adaptive filter is performed in the frequency domain based on signals err and ref and transferred to the variable filter part (Filter). The variable filter part is configured to filter time domain signal out and provide acoustic feedback path estimate signal fbp in the time domain. Alternatively, the variable filter part (Filter) may likewise work in the frequency domain. In this case, the subtraction unit '+' is located between the time to time frequency conversion unit (TF) and the signal processing unit (SPU), and the signal ref is used instead of signal out as an input to the variable filter part (Filter).

The signal processing unit (SPU in FIG. 1A, 1B, 1C) is e.g. adapted to adjust the electric input signal to an impaired hearing of the user.

To provide an improved de-correlation between the output and input signal, it may be desirable to add a probe signal to the output signal. This probe signal can be used as the reference signal to the algorithm part of the adaptive filter, and/or it may be mixed with the ordinary output of the hearing aid to form the reference signal. Alternatively, a (small) frequency or phase shift may be introduced in a signal of the forward path.

Figure 2:
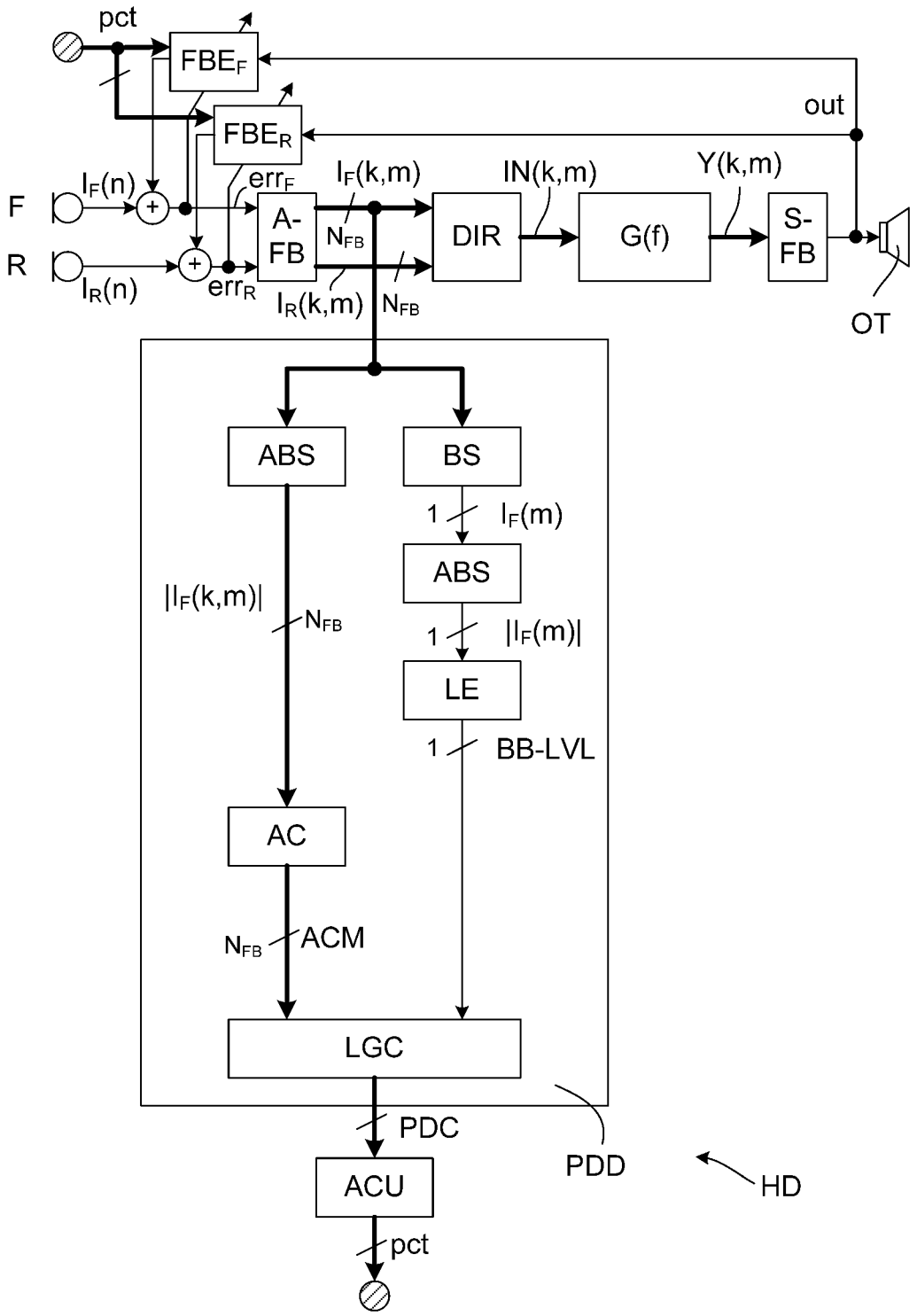
FIG. 2 illustrates an embodiment of a hearing device according to the present disclosure, FIG. 3A, 3B, 3C and FIG. 3D schematically shows four exemplary criteria according to the present disclosure for controlling an anti-feedback system based on detector signals from two detectors.

FIG. 2 shows an embodiment of a hearing device according to the present disclosure. The embodiment of a hearing device shown in FIG. 2 is a further specified embodiment of the hearing device embodiments illustrated in FIG. 1A, 1B, 1C as regards the power down detector and control unit (PDD-ACU in FIG. 1A, 1B, 1C). The hearing device (HD) is e.g. embodied in a hearing aid configured to provide a level and/or frequency dependent gain to an input audio signal from the environment of a user of the hearing aid to thereby compensate for a hearing impairment of the user. Such compensation is e.g. implemented by processing algorithms of a forward path of the hearing aid (between one or more input transducer(s) (here two microphones denoted F and R) and output transducer(s) (here a loudspeaker denoted OT)), cf. blocks DIR (providing spatial filtering to reduce noise) and G(f) (providing a gain to compensate for hearing impairment). The forward path further comprises a time to frequency conversion unit (AFB, here an analysis filter bank) and a frequency to time domain conversion unit (S-FB, here a synthesis filter bank). The front (F) and rear (R) microphones (e.g. relating to a) locations of the microphones in a hearing aid, when a user is wearing the hearing aid, and b) to a look direction defined by a user's nose) convert sound from the environment to time variant electric signals $I_F(n)$ and $I_R(n)$, respectively, n being a time index. Each of the microphone paths comprises a subtraction unit ('+') for subtraction of a signal representative of an estimate of the respective acoustic feedback paths from the output transducer (OT) to the respective front (F) and rear (R) microphones. The acoustic feedback path estimates are provided by respective feedback estimation units ($FBE_F$, $FBE_R$) for the front and rear microphones. The feedback estimation units ($FBE_F$, $FBE_R$) and the subtraction units ('+) together form part of a respective front and rear anti-feedback systems. The feedback corrected (time domain) signals ($err_F$, $err_R$) provided by subtraction units ('+') of the front and rear microphone paths are fed to respective analysis filter banks (AFB) to provide the signals in a time frequency representation in the form of electric input signals $I_F(k,m)$ and $I_R(k,m)$, respectively, k being a frequency index and m being a time index, respectively. The filter banks (AFB) provide the signals in a number $N_{FB}$ of frequency bands. The time-frequency domain signals are fed to a beamformer unit DIR providing a beamformed (and possibly further noise reduced) signal IN(k,m). A gain unit G(f) is configured to apply a gain profile (intended to compensate a user's hearing impairment) to the beamformed input signal IN(k,m) and to provide a processed signal Y(k,m) (in the time-frequency domain). A synthesis filter bank (S-FB) converts the processed signal Y(k,m) from a time-frequency domain signal to a time domain signal out, which is fed to the output transducer (OT) for conversion to a sound for being presented to a user of the hearing device (HD). The time domain output signal out is fed to the respective feedback estimation units ($FBE_F$, $FBE_R$) for the front and rear microphones. The feedback estimation units ($FBE_F$, $FBE_R$) may alternatively be implemented fully or partially in the frequency domain (by branching off from or inserting signals in the frequency domain part of the forward path and/or by introducing relevant time <-> frequency converters).

The lower part of FIG. 2 exemplifies an embodiment of a power down detector (PDD) and activation control unit (ACU) (denoted PDD-ACU in FIG. 1A, 1B, 1C) according to the present disclosure.

The power down detector (PDD) comprises two detectors, an autocorrelation detector and a broadband level detector, each providing a detector signal for characterizing a signal of the forward path (here feedback corrected input signal $I_F(k,m)$ from the front microphone (F)). Other signals could be chosen as inputs to the detectors, e.g. the input signal $I_R(k,m)$ from the rear microphone (R) or the beamformed signal IN(k,m) or one of the time-domain input signals from one of the microphones, etc.). The input signals to the detectors may be equal or different. The input signal $I_F(k,m)$ from the front microphone (F) is split into two branches, one for each of the detectors.

The left branch represents the autocorrelation detector and provides a measure ACM of autocorrelation in the input signal $I_F(k,m)$. The left branch comprises an ABS-unit (ABS) for providing absolute values input signal $|I_F(k,m)|$ of the generally complex values of each of the time-frequency units of the input signal $I_F(k,m)$. In the embodiment of FIG. 2, the input signal $I_F(k,m)$ is represented by the same number $N_{FB}$ of bands in the auto correlation detector as in the forward path. This need not be the case. A smaller number of bands $N_{AC}$ may e.g. be considered in the auto correlation detector than in the forward path. In an embodiment, a broadband autocorrelation measure ACM may be determined and used to determine a resulting power control input. An autocorrelation unit (AC) provides the autocorrelation measure ACM, e.g. based on a calculation of the autocorrelation function or a simplified (preferably less power consuming) measure, e.g. based on spectral flatness SFM of the input signal, cf. description below related to FIG. 4A, 4B. In an embodiment, the auto-correlation measure is determined in the same (or in at least some of the) frequency bands wherein the acoustic feedback path(s) is/are estimated (in respective feedback estimation unit(s)).

The right branch represents a broadband level detector and provides a broadband level BB-LVL of the input signal $I_F(k,m)$. The right branch comprises a band sum unit (BS) for providing an accumulated broadband signal $I_F(m)$ in the time domain and an ABS-unit (ABS) for providing an absolute value of the input signal $|I_F(m)|$. A level estimator (LE) provides an estimate the level of the signal $|I_F(m)|$, representing the broadband level BB-LVL of the input signal $I_F(k,m)$.

The autocorrelation measure ACM and the broadband level BB-LVL are fed to a logic unit LGC for applying a logic criterion (or one or more logic criteria, e.g. involving probabilistic or binary values of the detector signals) to the detector signals ACM and BB-LVL to provide a resulting detector signal PDC, which is fed to the activation control unit (ACU).

In the embodiment of FIG. 2, the autocorrelation measure ACM is provided on a frequency band level (k,m). This has the advantage that the power control can be considered on a sub-band level. Alternatively, the autocorrelation measure ACM can be provided as a single broadband value. The detector values may be binary or continuous numbers (on a sub-band level or broadband level).

The activation control unit (ACU) comprises (e.g. predetermined) criteria for selecting one of a number of modes of operation of the anti-feedback system(s) based on the resulting detector signal PDC.

The respective feedback estimation units ($FBE_F$, $FBE_R$) for the front and rear microphones are controlled by the power control signal pct from the activation control unit (ACU), cf. bottom part of FIG. 2. The activation control unit (ACU) provides a (such as one or more) power mode control signal(s) pct, here indicated as a band level signal by bold arrow representing pct (as opposed to a thin line arrows, e.g. BB-LVL). The number of bands may be equal to or smaller than the number of bands $N_{FB}$ of the input signal $I_F(k,m)$. This allows the feedback estimation units ($FBE_F$, $FBE_R$) to be controlled on a corresponding band level, e.g. to put the feedback estimation units ($FBE_F$, $FBE_R$) in different modes of operation (e.g. ON and OFF) depending on the values of the resulting detector signal PDC (and the criteria of the activation control unit (ACU)) in the frequency bands in question.

FIG. 3 shows four exemplary criteria (FIG. 3A, 3B, 3C and FIG. 3D) according to the present disclosure for controlling an anti-feedback system based on detector signals from two detectors.

Figure 3A:
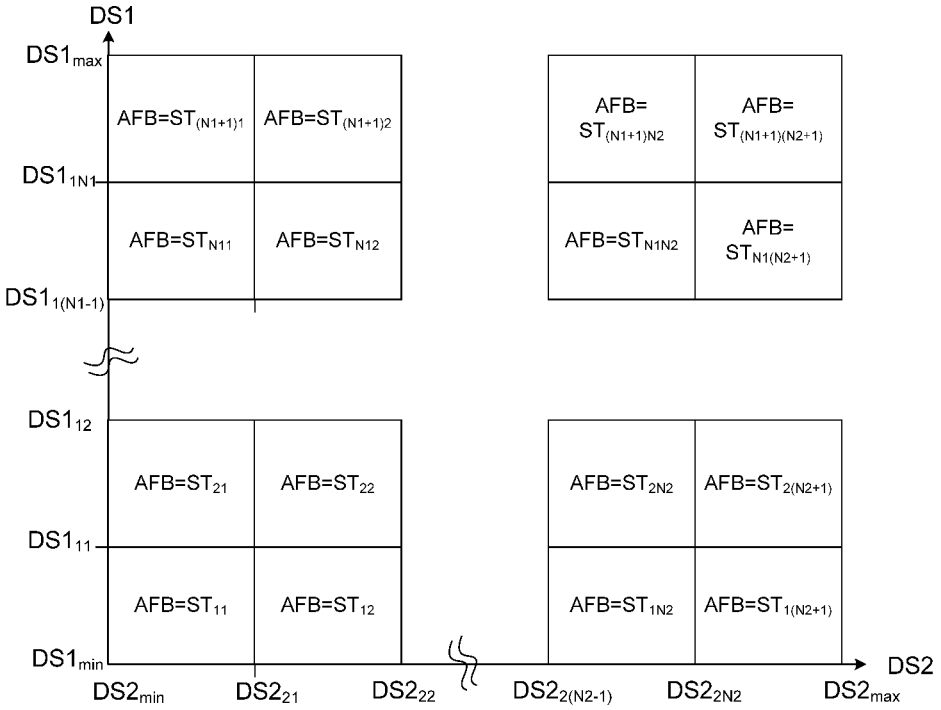

FIG. 3A illustrates a first exemplary possible modes of operation ($ST_{xy}$) of the anti-feedback system (AFB), each specific mode being defined by an AND combination of two sub-ranges of values of two detector signals DS1 and DS2. Each of the detector signals DS1 and DS2 take on values between a minimum and a maximum value [$DS1_{min}$; $DS1_{max}$] and [$DS2_{min}$; $DS2_{max}$], respectively. The range of valid values [$DS1_{min}$; $DS1_{max}$] of the first detector signals DS1 is divided into (N1+1) sub-ranges. Likewise, the range of valid values [$DS2_{min}$; $DS2_{max}$] of the second detector signals DS2 is sub-divided into (N2+1) sub-ranges. Thereby, a multitude (N1+1)(N2+1) of distinct (AND) combinations of sub-ranges of the two detector signals DS1 and DS2 are defined (e.g. mode $ST_{22}$ corresponds to combination ($DS_{11} \leq DS1 \leq DS_{12}$) AND ($DS_{21} \leq DS2 \leq DS_{22}$). In an embodiment, each combination of sub-ranges is associated with a different mode of operation ($ST_{xy}$) of the anti-feedback system (as indicated in FIG. 3A). In an embodiment, a number (more than 1) of the different combinations of sub-ranges are associated with the same different mode of operation ($ST_{xy}$) of the anti-feedback system.

Figure 3B:
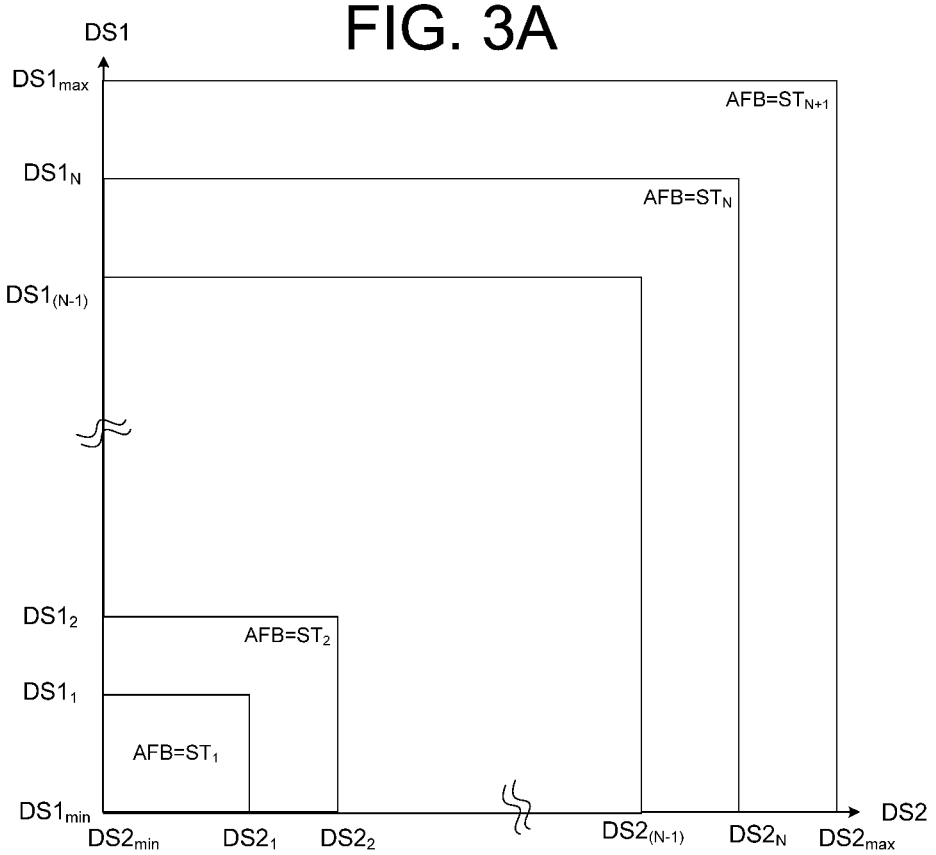

FIG. 3B illustrates a second exemplary possible modes of operation ($ST_{xy}$) of the anti-feedback system (AFB), each specific mode being defined by an OR combination of two sub-ranges of values of two detector signals DS1 and DS2. As in FIG. 3A, each of the detector signals DS1 and DS2 take on values between a minimum and a maximum value [$DS1_{min}$; $DS1_{max}$] and [$DS2_{min}$; $DS2_{max}$], respectively. Each or the range of valid values [$DS1_{min}$; $DS1_{max}$] and [$DS2_{min}$; $DS2_{max}$] of the first and second detector signals DS1 and DS2, respectively, are divided into (N+1) sub-ranges. Thereby, a multitude (N+1) of distinct (OR) combinations of sub-ranges of the two detector signals DS1 and DS2 are defined (e.g. mode $ST_2$ corresponds to combination [($DS1_1 \leq DS1 \leq DS1_2$) AND ($DS2 \leq DS2_2$)] OR [($DS2_1 \leq DS2 \leq DS2_2$) AND ($DS1 \leq DS1_2$]).

Figure 3C:
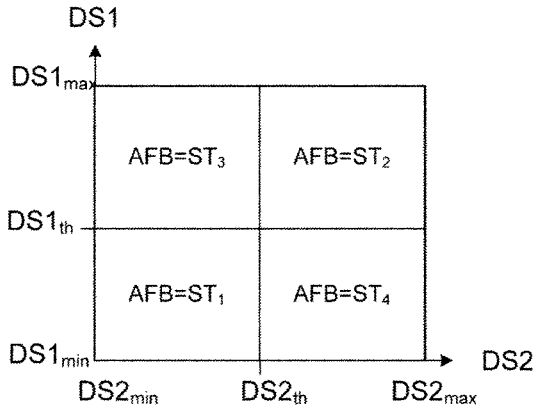

FIG. 3C schematically illustrates criteria for bringing the anti-feedback system into each of four states (ST1, ST2, ST3, ST4) defined by a combination of two detector signals (DS1, DS2), each detector signal lying within minimum ($DS1_{min}$, $DS2_{min}$) and maximum values ($DS1_{max}$, $DS2_{max}$). Two sub-ranges are defined for each detector signal by an intermediate (threshold) value ($DS1_{th}$, $DS2_{th}$) lying between the minimum and maximum values. FIG. 3C corresponds to FIG. 3A with N1=N2=1.

$$ST1: (DS1_{min} \leq DS1 \leq DS1_{th}) \text{ AND } (DS2_{min} \leq DS2 \leq DS2_{th})$$

$$ST2: (DS1_{th} < DS1 \leq DS1_{max}) \text{ AND } (DS2_{th} < DS2 \leq DS2_{max})$$

$$ST3: (DS1_{th} < DS1 \leq DS1_{max}) \text{ AND } (DS2_{min} \leq DS2 \leq DS2_{th})$$

$$ST4: (DS1_{min} \leq DS1 \leq DS1_{th}) \text{ AND } (DS2_{th} < DS2 \leq DS2_{max})$$

The four states may e.g. correspond to three different ON-states and an OFF state of the feedback cancellation system.

Figure 3D:
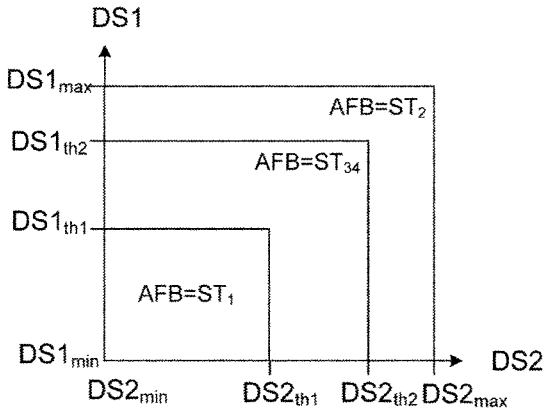

FIG. 3D schematically illustrates criteria for bringing the anti-feedback system into each of three states (ST1, ST2, ST34) defined by a combination of two detector signals (DS1, DS2), each detector signal lying within minimum ($DS1_{min}$, $DS2_{min}$) and maximum values ($DS1_{max}$, $DS2_{max}$). Three sub-ranges are defined for each detector signal by two intermediate (threshold) values ($DS1_{th1}$, $DS1_{th2}$, $DS2_{th1}$, $DS2_{th2}$) lying between the minimum and maximum values. FIG. 3D corresponds to FIG. 3B with N=2.

$$ST1: (DS1_{min} \leq DS1 \leq DS1_{th1}) \text{ AND } (DS2_{min} \leq DS2 \leq DS2_{th1})$$

$ST2$: $(DS1_{th2}<DS1\leq DS1_{max})$ OR $(DS2_{th2}<DS2\leq DS2_{max})$ $ST34$: $[(DS1_{th1}<DS1\leq DS1_{th2})$ OR $(DS2_{th1}\leq DS2<DS2_{ths})]$ AND $[(DS1\leq DS1_{th2})$ AND $(DS2\leq DS2_{th2})]$ The three states may e.g. correspond to two different ON-states and an OFF state of the feedback cancellation system.

Figure 4A:
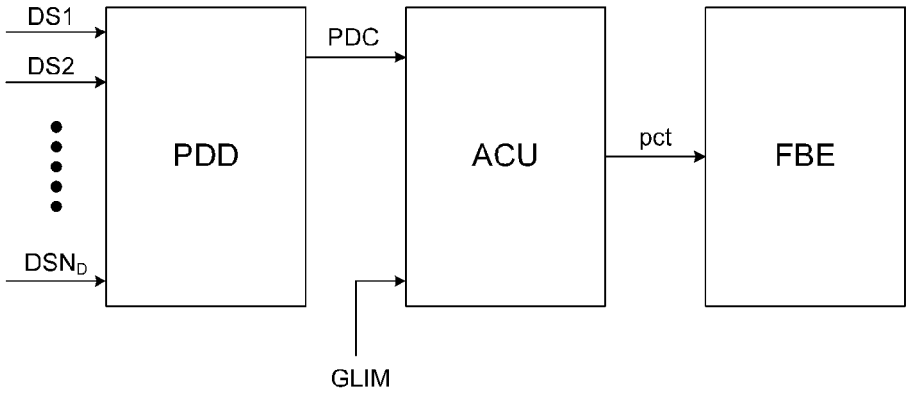
FIG. 4A shows a block diagram of an embodiment of a power down/power on controller for an anti-feedback system of a hearing device according to the present disclosure.
Figure 4B:
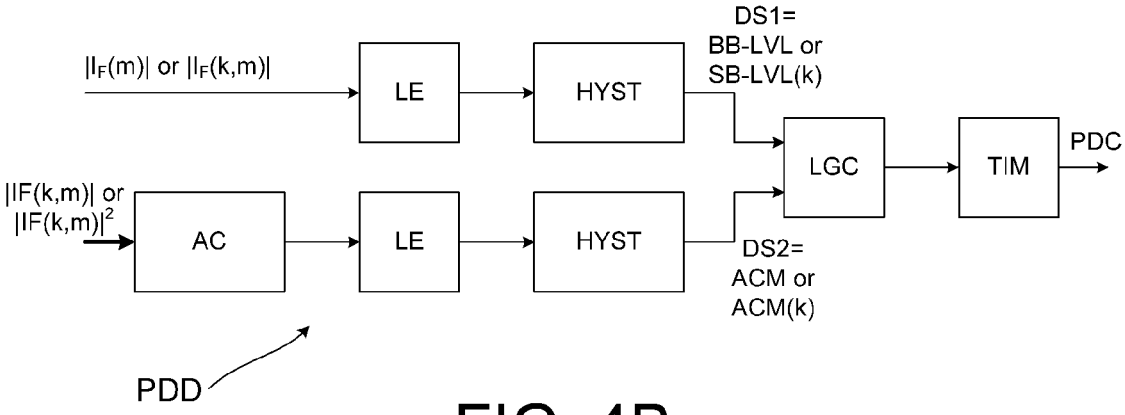
FIG. 4B shows a power down/power on detector for an anti-feedback system of a hearing device according to the present disclosure.

FIG. 4A shows a block diagram of an embodiment of a power down/power on controller, and FIG. 4B shows a power down/power on detector for an anti-feedback system of a hearing device according to the present disclosure.

FIG. 4A illustrates a power down detector (PDD) and activation control unit (ACU) coupled to a feedback estimation unit (FBE) to control a mode of operation regarding a level of power consumption of the feedback estimation unit (FBE), as e.g. discussed in connection with FIGS. 1A, 1B, 1C and 2. The power down detector (PDD) is configured to decide, based on a number of detector signals DS1, DS2, . . . , $DSN_D$, whether the anti-feedback system should be scaled down or up and sends a corresponding control signal to the activation control unit (ACU). The activation control unit (ACU) effectuates the scaling down or up (mode control) by sending a number of control signals pct to the feedback estimation unit (FBE). The activation control unit (ACU) may receive other input signals to govern the determination of the power control signal(s) pct. In FIG. 4A, an input signal GLIM for limiting the allowable gain changes during a power down and/or a power up of the anti-feedback system (cf. e.g. FIG. 5 and corresponding discussion below). Other limiting parameters may be fed to the activation control unit (ACU) to implement particular modes of operation or to define transitions (e.g. timing) from one mode of operation to another.

The exemplary concept implemented in FIG. 2 is based on monitoring the broadband level (BB-LVL) and auto-correlation (AC) of one of the microphone signals (here 'front' microphone signal $I_F$, cf. also FIG. 2). A block diagram of an exemplary implementation of the concept is shown in FIG. 4B. Instead of the broadband level (BB-LVL, e.g. based on input signal $|I_F(m)|$), a level estimate (SB-LVL) on a per frequency sub-band basis may be provided (e.g. based on input signal $|I_F(k,m)|$).

The input signal (e.g. $|I_F(k,m)|$ or $|I_F(k,m)|^2$) to the auto correlation detector (AC) is a time-frequency domain signal, e.g. based on an output signal of an analysis filter bank, i.e. a signal composed of M/2 bands, e.g. ranging from 0 to $f_s/2$ Hz, e.g. 10 kHz (M being e.g. the number of frequency bins or bands of a fast Fourier transformation (FFT), e.g. a 512 point FFT, or the number of frequency bands in a filter bank, e.g. providing 64 bands, $f_s$ being a sampling frequency, e.g. 20 kHz). Based on this band split signal, or a subset of the bands (e.g. the bands where the anti-feedback system is active, e.g. above a lower AFB-threshold frequency $f_{AFB,th}$, e.g. above 1.5 kHz), the auto-correlation AC unit provides an auto-correlation measure ACM. In an embodiment, auto-correlation is estimated using a Spectral Flatness Measure (SFM) given by the geometric mean divided by the arithmetic mean, i.e.

$$SFM = \frac{\sqrt[N]{\prod_{n=0}^{N-1} S_{xx}[n]}}{\frac{1}{N}\sum_{n=0}^{N-1} S_{xx}[n]} \quad \text{Equation (1)}$$

where $S_{xx}$ is the power spectrum of the signal x. By taking $\log_2$ to the expression in Eq. (1), an expression of the Spectral Flatness Measure (SFM) more suited for implementation in a logarithmic environment can (in a second embodiment) be achieved:

$$SFM = \log_2\left(\frac{\sqrt[N]{\prod_{n=0}^{N-1} S_{xx}[n]}}{\frac{1}{N}\sum_{n=0}^{N-1} S_{xx}[n]}\right) \quad \text{Equation (2)}$$

$$SFM = \frac{1}{N}\sum_{n=0}^{N-1} \log_2(S_{xx}[n]) - \log_2\left(\frac{1}{N}\sum_{n=0}^{N-1} S_{xx}[n]\right)$$

The SFM AC measure of Eq. 2 is close to 1 when $S_{xx}$ is flat (white noise) and close to 0 when $S_{xx}$ is peaky (pure tone). To obtain an AC measure that is linearly proportional to the amount of autocorrelation, an inversion of the SFM measure is performed (e.g. in that ACM=−SFM of eq. 2). The dynamic range of the SFM is primarily influenced by the choice of filterbank, which provides the power spectrum. Any other appropriate AC measure can be used as appropriate for the practical application (e.g. adapted to the specific hardware and/or software configuration, power constraints, etc.). In an embodiment, the AC-measure is based on a broadband (e.g. time-domain) calculation of autocorrelation.

Both the broadband level and the AC measure are e.g. passed through a level estimator (LE) with a relatively fast attack time (low→high level and high→low SFM transition) and a relatively slow release time (high→low level and low→high SFM transition). The level estimators are introduced in order to limit the number of transitions from one mode to the other (e.g. OFF to ON and vice versa). By having a slow release, the power is kept ON for a minimum period directly related to the release time constant. The same function is e.g. provided by hysteresis blocks (HYST). The outputs of the respective hysteresis blocks (HYST) represent (stable, 'low-pass filtered') values of broadband level (BB-LVL) and AC measure (ACM), which are logically combined according to a predetermined criterion or criteria in block LGC. The criteria may be based on logic operations, e.g. comprising Boolean operators (AND, OR, XOR, etc. or negations thereof). Furthermore, a Timer (block TIM in FIG. 4B) has been inserted to assure that the power is kept ON for a minimum period, which can be determined by parameter in the Timer. Thereby the number of (unnecessary) ON-OFF and OFF-ON transitions is reduced. One of the reasons for limiting the number of transitions from OFF to on and vice versa, is that is takes some time to scale up the anti-feedback system. Furthermore, a gain reduction is preferably introduced, while scaling up the AFB system in order to prevent the risk of howl (cf. GLIM in FIG. 4A). An exemplary course of events during a power ON (activation) of the AFB-system is illustrated in FIG. 5.

Figure 5:
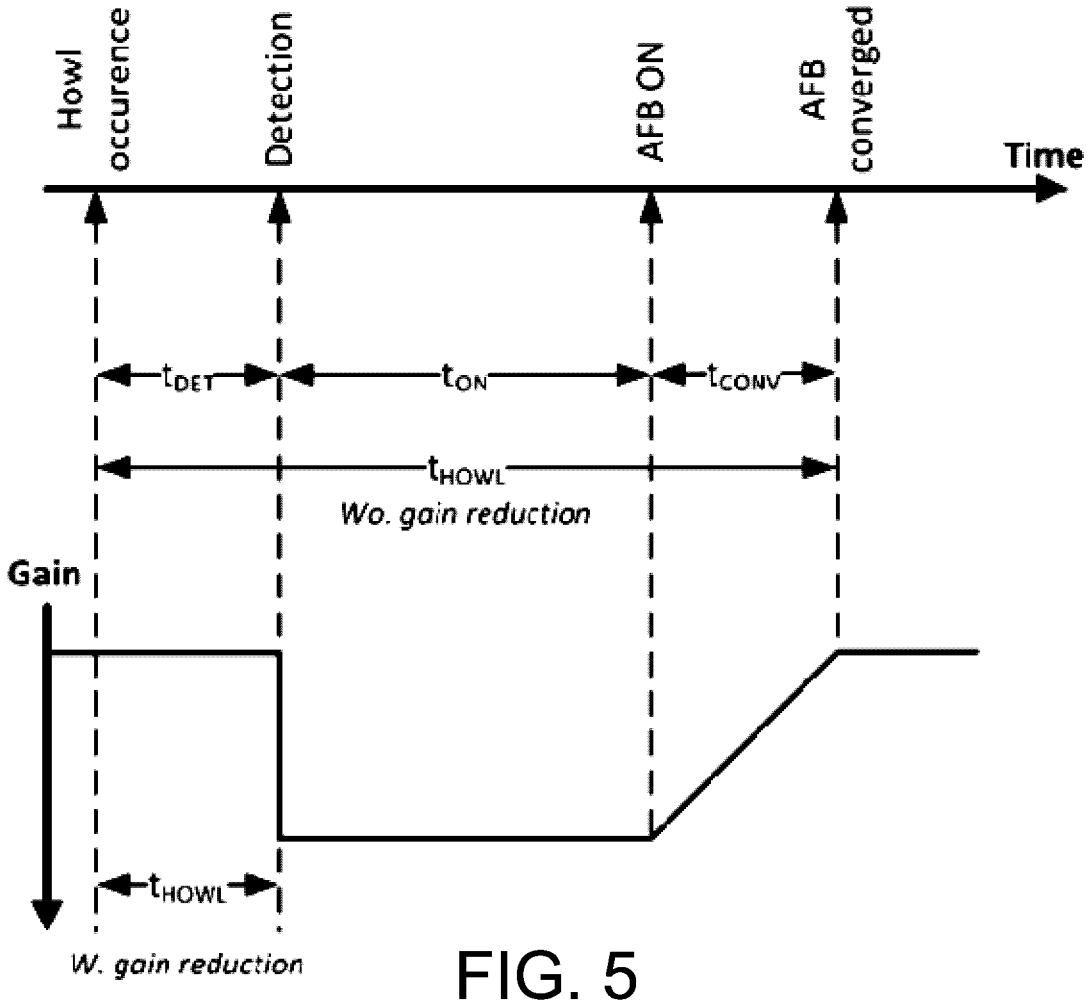
FIG. 5 shows an exemplary Power ON timing of the anti-feedback system according to the present disclosure when the anti-feedback system is brought from an OFF-mode to an ON-mode of operation, FIG. 6A, FIG. 6B

FIG. 5 shows an exemplary Power ON timing of the anti-feedback system according to the present disclosure when the anti-feedback system is brought from an OFF-mode to an ON-mode of operation.

When a howl or near howl occur it takes $t_{DET}$ s before it is detected. At that time a gain reduction is introduced and the AFB system is powered ON/scaled up, which takes $t_{ON}$ s. Once the AFB system is running it takes $t_{CONV}$ s further for the system to converge to the acoustic feedback path— during this period, the gain is gradually increased until no gain reduction resides. Other courses of the timing of the AFB-power ON (after a partial power down) may be envisioned, and implemented depending of the specific application. The slopes of the gain changes during power on of the AFB-system are preferably configurable, to minimize artifacts as indicated by dashed lines in FIG. 5 (cf. changes of Gain around Time=Detection and during convergence of the AFB-algorithm (between Time=AFB ON and AFB Converged) in FIG. 5).

Ideally, the anti-feedback system should be in an ON-mode of operation, and continuously updating the filter coefficients of an adaptive filter for estimating the acoustic feedback path (thereby updating the 'estimate of the acoustic feedback path') in situations where the acoustics around the hearing device are dynamic. 'Dynamic acoustics' is in the present context taken to mean that the acoustic feedback path is changing rapidly with time (e.g. within ms or a few s, as opposed to when it is static, e.g. over tens of seconds or more). Since the anti-feedback system itself cannot be used for detection of dynamic acoustics, indicators or detectors of such dynamic acoustics must be found in other parts of the hearing device. Below possible indicators are proposed:

- Level changes; a high level may indicate howl or a risk of howl.
- Gain changes; a low gain may indicate howl or a risk of howl.
- Autocorrelation (AC); a relatively high autocorrelation may indicate (near) howling
- Noise reduction gain or wind noise gain; when the noise reduction gain is high, it is an indication of the presence of noise i.e. little autocorrelation, and hence low risk of howl, and vice versa.
- Front/rear signal level differences; due to the physical distance between the two microphones, level differences can be detected in cases with dynamic acoustics.
- Binaural autocorrelation detection; different levels at the two hearing devices of a binaural hearing system may indicate a dynamic acoustic situation.

Figure 6A:
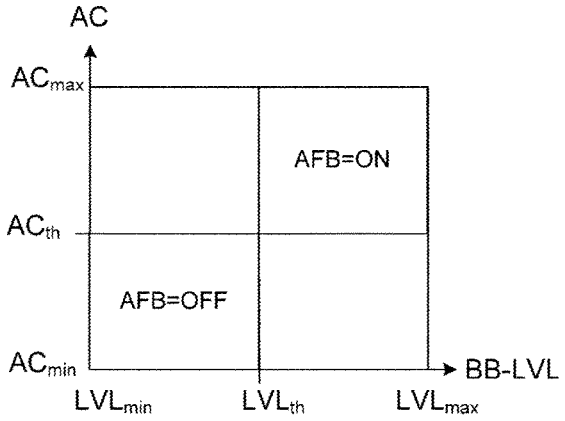
FIG. 6C shows three exemplary criteria according to the present disclosure for controlling an anti-feedback system based on detector signals from an auto-correlation detector and a level detector.
Figure 6B:
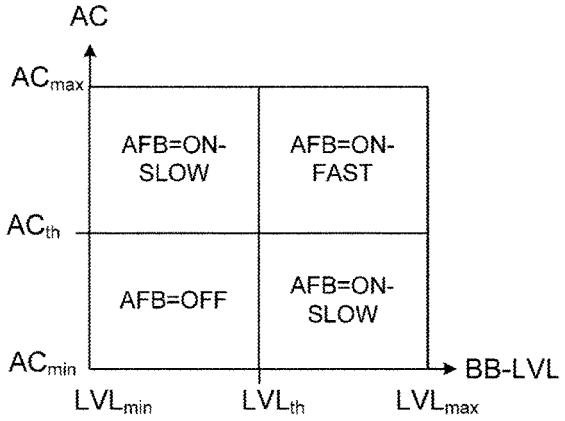
Figure 6C:
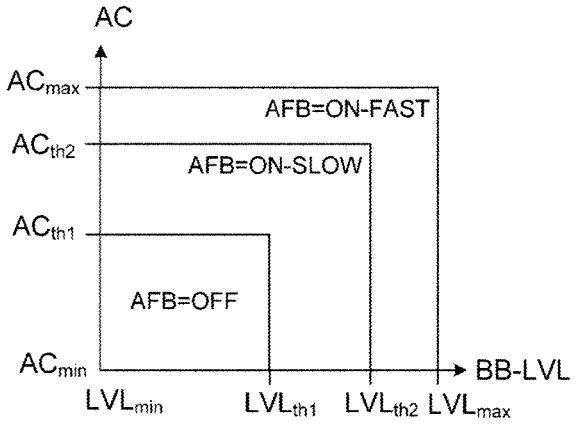

Three exemplary criteria according to the present disclosure for controlling an anti-feedback system based on detector signals from an auto-correlation detector and a level detector are shown in FIG. 6A, FIG. 6B and FIG. 6C. The activation control unit (AFB-CONT in FIG. 2) is configured to control the anti-feedback system based on a predefined criterion comprising a number of detector signals. In the embodiment of a hearing device shown in FIG. 2, where the activation control unit bases its control on two detector signals ($N_D$=2), auto-correlation and broad-band level estimates of a signal of the forward path, three exemplary different criteria are graphically illustrated in FIGS. 6A, 6B and 6C, respectively.

FIG. 6A illustrates the following criteria for bringing the anti-feedback system into an ON-state and an OFF-state, respectively:

$$\text{ON: } (AC_{th}<AC\leq AC_{max}) \text{ AND } (LVL_{th}<BB\text{-}LVL\leq LVL_{max})$$

$$\text{OFF: } (AC_{min}\leq AC\leq AC_{th}) \text{ AND } (LVL_{min}\leq BB\text{-}LVL\leq LVL_{th})$$

In the OFF-state, the feedback cancellation system is turned into a low-power mode, where it does not estimate the acoustic feedback path and thus does not cancel the acoustic feedback path. The aim of the OFF-state is to save power by not activating the feedback estimation unit. In the ON-state, the feedback cancellation system is on and a feedback estimate is repeatedly determined with a predefined or dynamically determined adaptation rate.

FIG. 6B illustrates a first criterion for bringing the anti-feedback system into an ON-state (comprising an ON-FAST and an ON-SLOW mode) and an OFF-state, respectively:

$$\text{ON-FAST: } (AC_{th}<AC\leq AC_{max}) \text{ AND } (LVL_{th}<BB\text{-}LVL\leq LVL_{max})$$

$$\text{ON-SLOW: } [(AC_{th}<AC\leq AC_{max}) \text{ AND } (LVL_{min}\leq BB\text{-}LVL<LVL_{th})] \text{ OR } [(AC_{min}\leq AC\leq AC_{th}) \text{ AND } (LVL_{th}<BB\text{-}LVL\leq LVL_{max})]$$

$$\text{OFF: } (AC_{min}\leq AC\leq AC_{th}) \text{ AND } (LVL_{min}\leq BB\text{-}LVL\leq LVL_{th})$$

The ON-FAST and ON-SLOW modes represent a mode, where the feedback cancellation system is on and a feedback estimate is repeatedly determined with a predefined or dynamically determined relatively high or relatively low update frequency $f_{upd}$, respectively. The ON-FAST mode consumes more power than the ON-SLOW mode due to the more frequent update frequency of the ON-FAST mode.

FIG. 6C illustrates a second criterion for bringing the anti-feedback system into an ON-state (comprising an ON-FAST and an ON-SLOW mode) and an OFF-state, respectively:

$$\text{OFF: } (AC_{min}\leq AC\leq AC_{th1}) \text{ AND } (LVL_{min}\leq BB\text{-}LVL\leq LVL_{th1})$$

$$\text{ON-SLOW: } [(AC_{th1}<AC\leq AC_{th2}) \text{ OR } (LVL_{th1}\leq BB\text{-}LVL<LVL_{th2})] \text{ AND } [(AC\leq AC_{th2}) \text{ AND } (BB\text{-}LVL\leq LVL_{th2})]$$

$$\text{ON-FAST: } (AC_{th2}\leq AC\leq AC_{max}) \text{ OR } (LVL_{th2}\leq BB\text{-}LVL\leq LVL_{max})$$

Other criteria based on auto-correlation and broad-band level estimates may be used. Similarly, other (or additional) detector signals may be used to control the anti-feedback system. In an embodiment, an output signal of a feedback detector for detecting whether tonal elements in a signal of the forward path at a given point in time comprises frequency elements that are due to feedback from the output transducer to the input transducer, is used to control the anti-feedback system, e.g. together with other sensor signals. In an embodiment, the detector signals from the broad-band (or sub-band) level detector and the auto-correlation detector are combined with a detector signal from a feedback detector for detecting whether or not tonal elements (e.g. in a given frequency band) present in a signal of the forward path at a given point in time are due to feedback from the output transducer to the input transducer.

Figure 7:
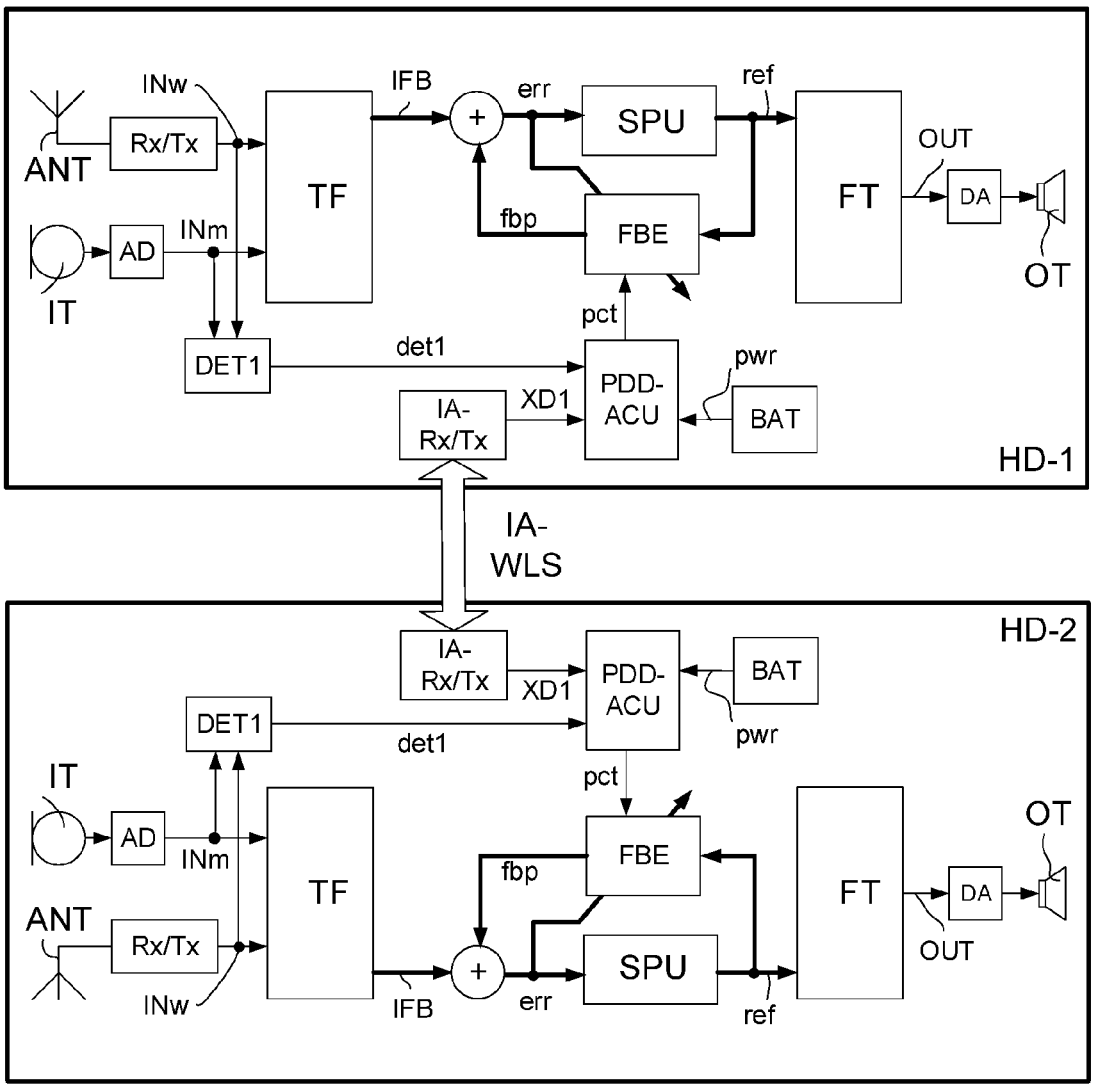
FIG. 7 shows an embodiment of a binaural hearing aid system comprising first and second hearing devices.

FIG. 7 shows a binaural hearing system (e.g. a binaural hearing aid system) according to the present disclosure. FIG. 7 shows an embodiment of a binaural hearing aid system comprising first and second hearing devices (HD1, HD2) adapted for being located at or in left and right ears of a user.

The hearing devices HD1 and HD2, which in various embodiments may be equivalent to the hearing devices described in connection with FIG. 1A, 1B, 1C, each comprise a time to time-frequency conversion unit (TF) for converting time domain input signals INm and INw to time-frequency input signals IFB allowing processing in the respective signal processing units (SPU) and feedback estimation units (FBE) in a number of frequency channels $FB_1$, $FB_2$, . . . , $FB_N$ (as indicated in the drawing by bold arrows representing signals IFB, err, ref, and fbp). Each hearing device comprises an input transducer (IT) comprising a microphone providing an analogue electric input signal, and an analogue to digital conversion unit (AD) providing digitized input microphone signal INm. Each hearing device further comprises a wireless transceiver comprising antenna (ANT) and transceiver circuitry (Rx/Tx) providing digitized input wireless signal INw. The time-frequency conversion unit (TF) is configured to select one of the input signals INm or INw (or a mixture of them) and provide it as band split signals IFB. The hearing devices HD1, HD2 each further comprise a time-frequency to time conversion unit (FT) for converting processed output signals ref to respective time domain signals OUT, which are fed to respective digital to analogue transformation units (DA) and on to the output transducer (OT), here a loudspeaker. As described in connection with FIGS. 1A, 1B, and 1C, each hearing device (HD1, HD2) further comprises an anti-feedback system comprising a feedback estimation unit (FBE) for estimating an acoustic feedback path from the output transducer (OT) to the input transducer (IT) and providing a signal fbp representative thereof. The anti-feedback system further comprises a summation (subtraction) unit ('+') for subtracting the signal fbp representative of the current acoustic feedback path from the (digitized) electric input signal (IFB) and providing a feedback corrected signal (error signal err), which is fed to the signal processing unit (SPU), and to the feedback estimation unit (FBE). The hearing devices (HD1, HD2) each further comprises a battery (BAT) for providing current to the functional blocks of the hearing device (cf. signals pwr), including to the anti-feedback system, and a power down detector and activation control unit (PDD-ACU) for controlling the modes of operation of the anti-feedback system to economize on its power consumption without sacrificing on solving its primary task: to avoid or minimize howl. The hearing devices (or alternatively the power down detector part (PDD)), each comprises one or more detectors (DET1), each providing a detector signal det1 for characterizing or analysing or receiving a) the microphone signal INm and b) the wirelessly received signal INw. In an embodiment, detector signals from one or more detectors external to the hearing devices (HD1, HD2), e.g. from a smartphone, may be received via antenna and wireless transceivers (ANT, Rx/Tx), e.g. represented by signal INw.

The hearing devices (HD1, HD2) of FIG. 7 are further adapted for exchanging information between them via a wireless communication link, e.g. a specific inter-aural (IA) wireless link (IA-WLS). The inter-aural link may e.g. be based on inductive (near-field) communication, or alternatively on radiated field (far-field) communication. The two hearing devices are adapted to allow the exchange of status signals, e.g. including the transmission of detector signals generated or received by a hearing device at a particular ear to the hearing device at the other ear. To establish the inter-aural link, each hearing device comprises antenna and transceiver circuitry (here indicated by block IA-Rx/Tx). The detector signals det1, XD1 from the local (det1) and the opposite (XD1) device, respectively, are e.g. used together to influence a decision regarding activation a particular mode of operation of the anti-feedback system (e.g. an ON-mode or an OFF-mode) in the local device (e.g. HD1). In an embodiment, the hearing assistance system further comprises an auxiliary device for transmitting an audio signal and/or a detector signal to the hearing devices.

The activation control part (ACU) is configured to control the anti-feedback system (including the feedback estimation unit FBE) based on the detector signals det1, XD1 (cf. power control signal pct), and to bring the anti-feedback system into one of at least two predefined modes based on the detector signals. The at least two predefined modes comprises an ON-mode and an OFF-mode. The ON-mode comprises a normal power consumption mode. The OFF-mode comprises a minimum power consumption mode. A main part of the processing of the hearing devices is performed in the time-frequency domain (cf. bold arrows on signals IFB, err, ref, fbp), but may alternatively be performed partially in the time domain and the time frequency domain. In an embodiment, the feedback estimation is performed partially in the time domain and partially in the time-frequency domain.

In an embodiment, the detector unit DET1 comprises an autocorrelation detector providing a measure of a current signal of the forward path, here a time-domain digitized microphone input signal INm. A current value of the autocorrelation measure of a given hearing device (HD1) is transmitted to the other hearing device (HD2) for comparison with a corresponding value generated in the other hearing device (HD2). In a situation, where the measures of an autocorrelation are indicative of the autocorrelation being larger than a threshold value in one of the hearing devices (HD1, HD2), but not the other, the source of the current autocorrelation is associated with a howl (or build-up of a howl) in that one of the hearing devices (e.g. HD2) having an autocorrelation larger than the threshold value. Consequently, an activation of an ON-mode of operation of the anti-feedback system in the relevant hearing device (HD2) may preferably be initiated. The autocorrelation measurements may e.g. be further compared with other detector signals (locally generated and/or received from the other hearing device), e.g. input level estimates, requested gain values, etc., to further improve the confidence of the decision on activation (or not) of a particular mode of operation of the anti-feedback system.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing device comprising a forward path between an input transducer for converting an input sound to an electric input signal and an output transducer for converting an electric output signal to an output sound, the forward path comprising a signal processing unit for applying a level and/or frequency dependent gain to the electric input signal or a signal originating therefrom and for providing a processed signal, and feeding the processed signal or a signal originating therefrom to the output transducer, an acoustic feedback path being defined from said output transducer to said input transducer;

a configurable anti-feedback system comprising a feedback estimation unit for providing an estimate of said acoustic feedback path, wherein the feedback estimation unit comprises an update part implementing an adaptive algorithm and a variable filter part for filtering an input signal according to variable filter coefficients determined by said adaptive algorithm;

a number of detectors, each providing a detector signal for characterizing a signal of the forward path;

wherein the hearing device further comprises an activation control unit configured to control the anti-feedback system based on said detector signals, and to bring the anti-feedback system into one of at least two predefined modes based on said detector signals, said at least two predefined modes comprising an ON-mode and an OFF-mode, and to allow operation of the anti-feedback system in a number of different ON-modes, including a maximum power consumption ON-mode, and wherein the update part of the feedback estimation unit is configured to update said filter coefficients of the variable filter part with a configurable update frequency.

2. A hearing device according to claim 1 wherein the anti-feedback system is operated in a number of frequency bands.

3. A hearing device according to claim 1 wherein at least one of said detector signals is frequency dependent.

4. A hearing device according to claim 1 wherein the activation control unit is configured to control the anti-feedback system based on a predefined criterion comprising said detector signals.

5. A hearing device according to claim 2 configured to allow the activation control unit to bring the anti-feedback system in a first band into a first one of said modes of operation, and to bring the anti-feedback system in a second band into a second one of said modes of operation.

6. A hearing device according to claim 1 wherein the anti-feedback system is configured to be operated only in a limited number of frequency bands.

7. A hearing device according to claim 1 wherein the number of detectors comprises a level detector for estimating a current level of a signal of the forward path.

8. A hearing device according to claim 1 wherein the number of detectors comprises an auto-correlation detector for providing a measure of the current auto-correlation of a signal of the forward path.

9. A hearing device according to claim 8 wherein the activation control unit is configured to bring the anti-feedback system in an ON-mode, if said measure of the current auto-correlation fulfils a predefined auto-correlation-criterion for the ON-mode AND if the current level of a signal of the forward path fulfils a predefined level-criterion for the ON-mode.

10. A hearing device according to claim 8 wherein the activation control unit is configured to bring the anti-feedback system in an OFF-mode, if said measure of the current auto-correlation fulfils a predefined auto-correlation-criterion for the OFF-mode AND if the current level of a signal of the forward path fulfils a predefined level-criterion for the OFF-mode.

11. A hearing device according to claim 1 comprising first and second input transducers, and corresponding first and second configurable feedback cancellation systems comprising first and second feedback estimation units for estimating first and second acoustic feedback paths from said output transducer to said first and second input transducers, respectively.

12. A hearing device according to claim 1 wherein—in a mode of operation of the anti-feedback system other than the maximum power ON-mode—the update frequency of the update part is scaled down by a predefined factor X compared to a maximum update frequency.

13. A hearing device according to claim 1 wherein the activation control unit is configured—in a specific ON-mode of operation—to control the update parts of the first and second feedback estimation units to alternatingly update the filter coefficients of the respective variable filter parts.

14. A hearing device according to claim 1 wherein the hearing device comprises a hearing aid, a headset, an earphone, an ear protection device or a combination thereof.

15. A hearing device according to claim 1 wherein a switching time period for activation of an ON-mode is smaller than the switching time period for activation of an OFF-mode.

16. A hearing device according to claim 1 wherein the number of detectors are configured to provide that a switching time period for activation of an ON-mode is smaller 100 ms.

17. A binaural hearing aid system comprising first and second hearing device according to claim 1, wherein the binaural hearing system is adapted to establish a communication link between the first and second hearing devices and to provide that information can be exchanged or forwarded from one to the other.

18. A binaural hearing aid system according to claim 17 configured to provide that a detector signal defining a measure of a first property of a signal of the forward path of a given hearing device is transmitted to the other hearing device for comparison with a measure of the first property of a signal of the forward path of the other hearing device, wherein the comparison is used to influence a whether or not a change of mode of operation of the anti-feedback system of the hearing aid in question should be initiated.

19. A binaural hearing aid system according to claim 18 wherein the property comprises auto-correlation.

20. A hearing device according to claim 1 configured so that the configurable update frequency has a maximum value in the maximum power consumption ON-mode of the anti-feedback system, and in different modes of operation of the anti-feedback system other than the maximum power consumption ON-mode, the update frequency of the update part is scaled down with different factors compared to said maximum value of the configurable update frequency.

* * * * *